United States Patent [19]

Magnin et al.

[11] Patent Number: 4,834,915

[45] Date of Patent: May 30, 1989

[54] PROCESS FOR THE IMMOBILIZATION OF ION EXCHANGE RESINS ORIGINATING FROM THE SECONDARY CIRCUITS OF PRESSURIZED WATER NUCLEAR REACTORS AND GAS-COOLED GRAPHITE-MODERATED REACTORS

[75] Inventors: Guy Magnin; Marie-Francoise Magnin nee Champeaud, both of Plaisir; Véronique Aubert, Les Clayes sous Bois; Claude Jaouen, Guyancourt, all of France

[73] Assignee: Societe Anonyme: Societe Generale Pour les Techniques Nouvelles - SGN, France

[21] Appl. No.: 157,039

[22] Filed: Feb. 16, 1988

[30] Foreign Application Priority Data

Dec. 16, 1987 [FR] France ..... 87 17596

[51] Int. Cl.[4] ..... G21F 9/16

[52] U.S. Cl. ..... 252/628

[58] Field of Search ..... 376/272, 308, 309, 310; 252/628, 625

[56] References Cited

U.S. PATENT DOCUMENTS

| | | | |
|---|---|---|---|
| 3,658,714 | 4/1972 | Verot et al. | 252/628 |
| 4,122,048 | 10/1978 | Buchwalder et al. | 252/628 |
| 4,293,437 | 10/1981 | Taponier et al. | 252/301.1 W |
| 4,500,449 | 2/1985 | Kuhnke et al. | 252/628 |
| 4,530,723 | 7/1985 | Smeltzer et al. | 252/628 |
| 4,663,086 | 5/1987 | Lefillatre | 252/628 |
| 4,710,318 | 12/1987 | Horiuchi et al. | 252/628 |
| 4,732,705 | 3/1988 | Laske et al. | 252/628 |
| 4,770,783 | 9/1988 | Gustavsson et al. | 252/628 |

FOREIGN PATENT DOCUMENTS

| | | |
|---|---|---|
| 1564878 | 4/1980 | United Kingdom . |
| 2101797 | 1/1983 | United Kingdom . |

*Primary Examiner*—Deborah L. Kyle
*Assistant Examiner*—Daniel Wasil
*Attorney, Agent, or Firm*—Poms, Smith, Lande & Rose

[57] ABSTRACT

The present invention relates to a process for the immobilization of ion exchange resins originating from the secondary circuits of pressurized water nuclear reactors and gas-cooled graphite-moderated reactors, wherein the ion exchange resins are saturated with a base, preferably sodium hydroxide, under conditions such that the pH of the medium is greater than about 9 and such as to favor the release of ammonia, after which the said resins are concreted with a hydraulic binder.

6 Claims, No Drawings

PROCESS FOR THE IMMOBILIZATION OF ION EXCHANGE RESINS ORIGINATING FROM THE SECONDARY CIRCUITS OF PRESSURIZED WATER NUCLEAR REACTORS AND GAS-COOLED GRAPHITE-MODERATED REACTORS

The present invention relates to a process for the immobilization of ion exchange resins originating from the secondary circuits of pressurized water nuclear reactors and gas-cooled graphite-moderated reactors.

It is known that the water in the secondary circuits of pressurized water nuclear reactors contains ammonia and that this aqueous ammonia is treated by means of ion exchange resins. These resins are of cationic type, but resins of anionic type are also used in order to ensure proper purification of this water.

In general, therefore, a mixture of cationic resins which have essentially fixed $NH_4^+$ ions and anionic resins whose sites are in the form of $OH^-$ will have to be immobilized for storage.

These resins have a relatively low level of radioactivity; nevertheless, certain current specifications or specifications envisaged for the fairly near future require these resins to be immobilized and stored under specific conditions similar to those used hitherto for immobilizing and storing so-called low-level and medium-level radioactive products.

The present invention relates to a process for the immobilization of the said resins for storage.

The immobilization process chosen is concreting, i.e. the general process—known per se—in which the products to be immobilized are coated in a hydraulic binder. The problem consists in pretreating the resins in such a way as to enable this immobilization process to be carried out and, if possible, to give a product with the best properties.

In the pretreatment process according to the invention, the ion exchange resins are saturated with a base, preferably sodium hydroxide, under conditions such that the pH of the medium is greater than about 9 and such as to favor the release of ammonia.

A base is understood as meaning a compound such as sodium, potassium, calcium or barium hydroxide. For reasons of economics, solubility and ease of use, preference is given to sodium hydroxide. This product can be used in the solid form or in solution.

As the "base" used in the pesent invention is intended to ensure, by ion exchange, that all the sites in the resins containing an $NH_4^+$ ion are saturated, this exchange should of course be carried out in an aqueous medium, which can consist wholly or partly of the water generally present in the batch of resins to be treated.

It has been pointed out that the pH of the (aqueous) medium must be greater than about 9; in actual fact, the pH must be sufficiently high for the $NH_4^+$ ions feed from the resins by exchange with the basic cation ($Na^+$) not to remain in the dissolved state in the said medium, but to produce gaseous ammonia, which will be released from the said medium.

Finally, it has been pointed out that it is desirable to use at least one means for favoring the release of the ammonia. In other words, steps should be taken to ensure that the gaseous ammonia which is released from the medium does not remain in prolonged contact with the surface of the said medium. In fact, if this contact were to exist, it is known that the said ammonia would tend to redissolve in the said medium, which—because of the equilibrium—would slow down the release of further quantities of ammonia. Of course, any known means for favoring this release can be used; examples which may be mentioned are sweeping the surface of the medium with a stream of air, exhausting (by means of a partial vacuum) the atmosphere situated above the said medium, or raising the temperature to a level which is sufficient but does not cause degradation of the resins.

The amount of "base" used must be at least that which permits total displacement of the $NH_4^+$ ions by the cation of the said base. In practice, since the proportion of cationic resins contained in the resins to be treated is often ignored, the amount of "base" used is at least sufficient for the cation of the said base to saturate all the sites in the resins, assuming that all the resins treated are cationic; it will be noted that the use of a larger amount of base than that which is necessary to ensure saturation of the sites can to a certain extent favor and accelerate the saturation phenomenon.

As can be seen, the process as described above causes ion exchanges only on the cationic resins contained in the resins to be treated. It actually turns out that, taking account of the very low radioactivity of the resins treated and the current specifications to be observed, it has been possible to determine that the harmful effects of the anionic resins on the setting phenomena associated with the hydraulic binder are not too significant.

However, it so happens that the process according to the invention can be improved if the anionic resins present in the resins to be treated are also stabilized by ion exchange. This stabilization can be effected by exchange of the $OH^-$ ions contained in the anionic resins with ions such as $NO_3^-$, $SO_4^{--}$, $CH_3COO^-$ etc. The most advantageous of the anions which can be used is the $NO_3^-$ ion on account of the stability obtained, its ease of use and its inertia with respect to the anions present during concreting. It is therefore possible to carry out the present invention by the successive or simultaneous use of a "base", as defined above and under the conditions indicated above, and an anionic compound providing, for example, the $NO_3^-$ ion. It is possible, for example, to use sodium nitrate and, if the pH of the medium is not high enough, sodium hydroxide.

The quantity of this anion (preferably $NO_3^-$) to be used can advantageously be calculated assuming that all the resin treated is of anionic type and that the aim is to saturate all the sites in this resin.

The non-limiting example which follows illustrates the invention.

50 l of an $NaNO_3$ solution containing 250 g/l and 20 kg of NaOH pellets are added to 100 l of 100% decanted resins.

After stirring for 4 h at a temperature of 60° C. under a reduced pressure of 0.2 bar, followed by cooling to room temperature, 200 kg of CLK cement are added. This produces 390 kg of coated material, the degree of incorporation of 100% decanted resins being 40% (by volume).

What is claimed is:

1. A process for the immobilization of ion exchange resin originating from the secondary circuit of a pressurized water nuclear reactor or gas-cooled graphite-moderated reactor, wherein said ion exchange resin has a pluality of ion exchange sites saturated with ammonia ion, said process comprising the steps of:

treating said ion exchange resin with a sufficient amount of a base to form a medium having a pH of greater than about 9 wherein ammonia gas is released from said medium;

removing the ammonia gas from said medium to form a media having a reduced ammonia content; and concreting said reduced ammonia media by treating said media with a sufficient amount of a hydraulic binder.

2. A process according to claim 1 wherein said base is selected from the group consisting of sodium hydroxide, calcium hydroxide and barium hydroxide.

3. A process according to claim 2 wherein said base is sodium hydroxide.

4. A process according to claim 1 wherein any anionic resin present in said ion exchange resin is stabilized by adding a compound providing nitrate ions to said medium.

5. A process according to claim 4 wherein said compound providing nitrate ions is sodium nitrate.

6. A process according to claim 1 wherein said hydraulic binder is CLK cement.

* * * * *